US005456342A

United States Patent [19]

Rekuc et al.

[11] Patent Number: 5,456,342

[45] Date of Patent: Oct. 10, 1995

[54] ROLLABLE LUGGAGE

[75] Inventors: Richard J. Rekuc, Pattenburg; James O'Shea, Annandale, both of N.J.

[73] Assignee: Royalox International, Inc., Phillipsburg, N.J.

[21] Appl. No.: 133,973

[22] Filed: Oct. 8, 1993

[51] Int. Cl.[6] ..... A45C 5/14

[52] U.S. Cl. ..... 190/18 A; 190/115; 280/37; 280/47.2

[58] Field of Search ..... 190/18 A, 103, 190/115, 117; 280/37, 655.1, 47.2, 47.315

[56] References Cited

U.S. PATENT DOCUMENTS

| | | | |
|---|---|---|---|
| 1,898,436 | 2/1933 | Frescott, Sr. | 190/18 A X |
| 2,670,969 | 3/1954 | Costikyan | 190/18 A X |
| 2,696,990 | 12/1954 | Davis | 190/18 A X |
| 2,893,523 | 7/1959 | Mitchell | 190/903 X |
| 2,919,138 | 12/1959 | Brower et al. | 190/18 A X |
| 4,792,025 | 12/1988 | Thomas | 190/18 A |
| 4,995,487 | 2/1991 | Plath | 190/18 A |
| 5,048,649 | 9/1991 | Carpenter et al. | 190/18 A |
| 5,108,119 | 4/1992 | Huang | 190/18 A X |
| 5,115,895 | 5/1992 | Myers | 190/18 A |
| 5,167,306 | 12/1992 | Carrigan, Jr. | 190/18 A |
| 5,291,976 | 3/1994 | Ku | 190/18 A |
| 5,295,565 | 3/1994 | Latshaw | 190/18 A |
| 5,323,886 | 6/1994 | Chen | 190/18 A |
| 5,335,759 | 8/1994 | Yeh | 180/18 A X |

FOREIGN PATENT DOCUMENTS

| | | | |
|---|---|---|---|
| 503373 | 9/1992 | European Pat. Off. | 190/18 A |
| 208915 | 4/1984 | Germany | 190/18 A |
| 1567437 | 5/1990 | U.S.S.R. | 190/18 A |

*Primary Examiner*—Sue A. Weaver
*Attorney, Agent, or Firm*—Herbert Dubno

[57] ABSTRACT

An article of luggage having a container body of the fabric-wall type can have a pull handle along its bottom and a wheel assembly by which the article is guided over the ground or floor. The wheel assembly comprises wheel housing members and, if desired, an impact shield member or spacer between the wheel housing members which enables the length of the wheel assembly to be adjusted to suit different widths of the article to which the assembly is to be applied. The handle can be withdrawn from a frame within the article which provides structure for the latter.

3 Claims, 7 Drawing Sheets

FIG. 2
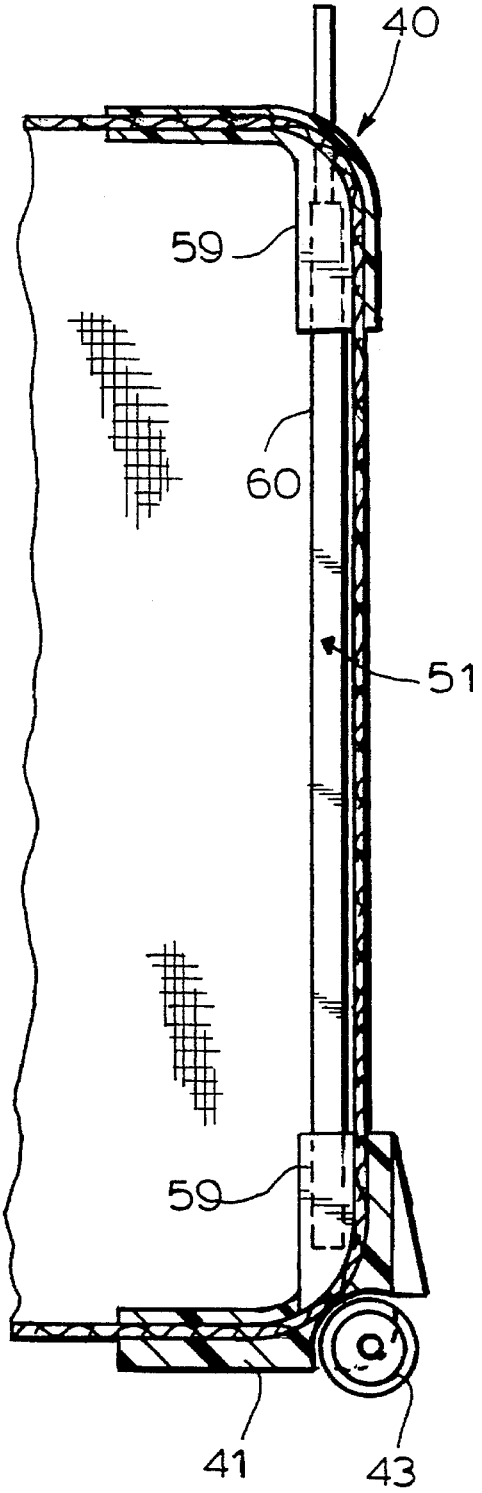
FIG. 5
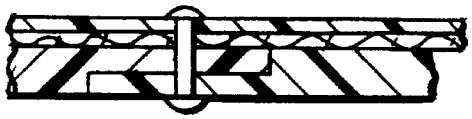
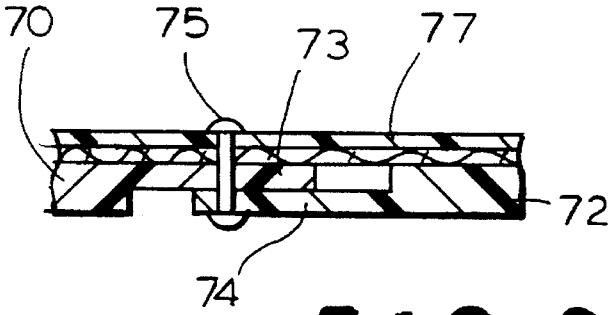
FIG. 6
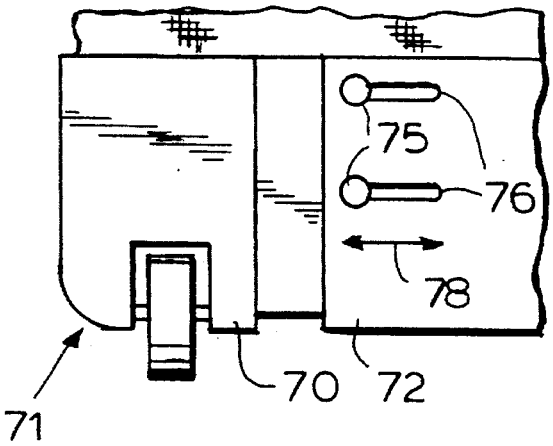
FIG. 4

ROLLABLE LUGGAGE

FIELD OF THE INVENTION

The present invention relates to an article of luggage of the type in which a container structure, usually of a low-wear fabric or other soft material, is provided with rollers or wheels enabling that article to be drawn along a surface, e.g. the ground or a floor. More particularly, the invention relates to the wheel and rigidifying structures of such an article and to a reduction in wear or injury of the body of the article when such an article contacts an obstruction.

BACKGROUND OF THE INVENTION

It has become common to provide an article of luggage whose case or body is provided with wheels and which may have a handle which can extend from the luggage body and by which the article can be drawn along a surface.

Frequently the container portion of that article, i.e. the body, is composed of a low-wear fabric, for example, a nylon, or other soft material which can become damaged should the article encounter an obstruction in its path or impact against some other element. Most frequently that impact occurs toward the bottom and rear of the article and can cause damage to the latter. Of course the principles discussed herein are also applicable to rigid-case luggage since such articles also can be damaged by impact as the rolling article encounters an obstruction.

Problems with respect to manipulation of the article over an obstruction such as a step or a flight of stairs can be encountered when the surface along which the article is drawn is not a continuous ramp. Finally, especially with soft luggage, i.e. luggage in which the container is formed by a highly flexible material such as a fabric, problems are encountered with respect to the shape retention or structuring of the article.

All of these problems have generated a variety of efforts to solve them, although most of the conventional solutions have not been fully satisfactory.

OBJECTS OF THE INVENTION

It is, therefore, the principal object of the present invention to provide an improved article of luggage and especially, an article of luggage having a flexible-wall body, e.g. of fabric, whereby some or all of the aforementioned drawbacks can be obviated.

Another object of this invention is to provide an improved article of luggage which has reduced damage or wear of the walls of the article as a result of contact of the article with obstructions as the article is drawn along a surface.

It is also an object of this invention to provide an improved article of luggage which can be fabricated more easily than earlier articles and which has improved structure and stiffness.

Yet another object of our invention is to provide an improved wheel assembly for an article of luggage whereby disadvantages of earlier wheel assemblies can be avoided.

It is also an object of this invention to provide an improved handle assembly for an article of luggage.

SUMMARY OF THE INVENTION

We have found that the drawbacks of excessive wear of the lower rear portion of a rolling article of luggage, resulting from impact with obstructions, for example, can be significantly reduced or eliminated by providing a wheel assembly along the lower portion and the rear wall of the container body, preferably extending onto the bottom wall thereof and which consists of at least two rigid members and wherein two members at least form wheel housings and all of these members are connected contiguously so that they extend the full width of the rear wall at its junction with the bottom wall and consequently form a shield against impact while simultaneously providing the mountings for the wheels.

For example, two wheel housings can be provided to span the width of the rear wall or a multiplicity of members can be so disposed with a plurality of spacer members interposed between the wheel housings.

Preferably, however, a single extruded shield member is interposed between two molded wheel housings forming the other two members of this assembly with the adjoining members being interfitted with one another.

To facilitate fabrication of the article, the identical wheel housings can be used for a wide range of luggage sizes (different widths) with the shield member being an extrusion which can be cut to length to fit precisely between the two wheel housings.

In addition or alternatively, the wheel housings and the shield member can interfit with one another with a degree of adjustability in the direction of the width of the article, utilizing, for example, slots in one or both of the members traversed by screws or rivets which allow a given wheel assembly to be extended or contracted to suit the respective width of the article.

More particularly, an article of luggage according to this invention can comprise:

- a generally rectangular parallelepipedal container having a top wall, a bottom wall, a front wall, a rear wall and two side walls;
- a handle on the container enabling same to be drawn along a surface; and
- a wheel assembly spanning a full width of the container across the rear wall and adjacent the bottom wall and shielding the container against impact with obstructions encountered by the article as the article is drawn along the surface, the wheel assembly including at least two members adjustably interconnected along the width to enable adjustment of the assembly to containers of different width, two of the members carrying respective wheels on which the article is supported as it is drawn along the surface.

According to another aspect of this invention, the wheel assembly is provided with roller means including at least one rolling body disposed preferably above each wheel and the respective wheel housing and which, upon encountering an obstruction, facilitates the drawing of the article over that obstruction with a minimum of wear on the assembly. Advantageously such antifriction means can include a multiplicity of rollers whose axes are parallel to the wheel axis and which are vertically spaced, one above another. Alternatively, the anti-friction means can include an array of mutually-spaced balls mounted in the respective wheel housing above the respective wheel and projecting from the wheel housing to encounter a step or other obstruction. The balls can be received in respective sockets and can be provided in vertically-spaced rows with the balls of the rows being staggered with respect to the row above or below.

According to a feature of the invention, the wheel assemblies include a central member and a pair of end members, e.g. the wheel housing, which are adjustable relative to the central member, i.e. the aforementioned shield, and which extend around the edges of the soft case at which the side walls and the bottom walls adjoin the rear wall to protect these edges, i.e. so as to constitute edge protectors.

According to another aspect of the invention, the handle has a pair of shanks which are guided in respective extrusions disposed within the body of the container along the vertical edges at which the rear wheel adjoins the side walls. These extrusions can be provided at opposite ends with detents which can grip the shanks in the outermost extreme position and the innermost extreme position of the handle to limit the slidability of the handle into the extrusion without frictionally retarding such slidability between these limiting positions.

According to the invention, the extrusions can be hollow and rectangular cross section metal members, e.g. of aluminum, which are received in sockets of rigid molded plastic upper and lower members disposed within the container along the top and bottom walls, respectively, and forming with the extrusions, respective limbs of a frame lying along the rear wall of the article and providing structure thereto.

With respect to this other aspect of the invention, therefore, the article of luggage can comprise:

a generally rectangular parallelepipedal container having a top wall, a bottom wall, a front wall, a rear wall and two side walls;

a container-stiffening frame disposed along the rear wall; and receiving the handle to enable the handle to be extended from and returned to the container; and a handle on the container enabling same to be drawn along a surface, the frame having members receiving the handle to enable the handle to be extended from and returned to the container.

BRIEF DESCRIPTION OF THE DRAWINGS

The above and other objects, features and advantages of the invention will become more readily apparent from the following description, reference being made to the accompanying highly diagrammatic drawing in which:

FIG. 2 is a vertical section through an article analogous to that of FIG. 1 illustrating another aspect of the invention;

FIG. 4 is a detail of a wheel assembly in elevational view;

FIG. 5 is a cross section through such a wheel assembly in one position;

FIG. 6 is a cross section analogous to that of FIG. 5 in another position;

SPECIFIC DESCRIPTION

Figure 1:
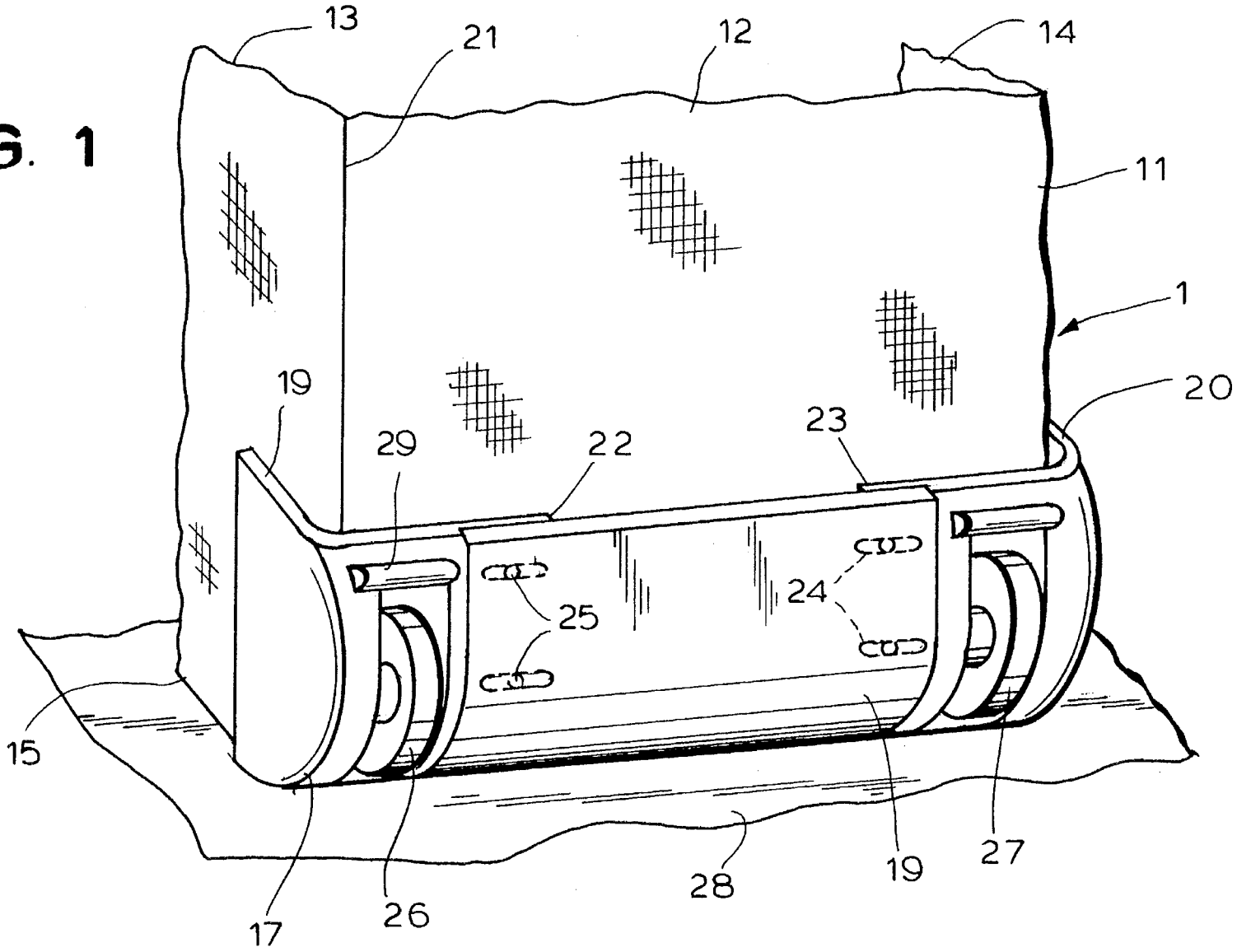
FIG. 1 is a diagrammatic perspective view of the rear portion of an article of luggage provided with a wheel assembly serving also as an impact shield.

As can be seen from FIG. 1, the article of luggage 10 can comprise a soft body 11 with a rear wall 12 and a pair of side walls 13 and 14 composed of fabric. The bottom wall adjoins the rear and side walls at 15.

At the lower portion of the rear wall, forming a shield against obstacles and the support for wheels on which the article can roll, is a wheel assembly 16 which comprises a pair of wheel housings 17 and 18, forming two members of this assembly, and a shield member 19 which is in the form of an extrusion and which extends form the rear wall around the bottom edge along the bottom wall. The assembly 16 is a rigid structure and the wheel housings 17 and 18 have portions 19, and 20 which extend around the side walls and thus form protectors for the edges 21, for example, joining the walls of the body 11 of the container at this region.

As is also apparent from FIG. 1, member 19 can be an extruded body which is cut to length to fit the width of the article 10 and is interposed between the wheel housings 17 and 18.

Some adjustabilty, also to accommodate the wheel assembly 16 to the width of the article can be provided by forming flanges 22 and 23 of the wheel housings with slots 24 through which rivets or screws 25 pass to attach the wheel assembly 16 to an inner rigid member within the container forming part of a structuring frame as will be described subsequently. The slot connection allows limited adjustment of the part 17 with respect to the part 19 and the part 18 with respect to the part 19 to accommodate different widths of the container body 11.

The wheel housings are provided with wheels 26 and 27 which are journaled on respective axles and which, when the article of luggage is tilted, engage the ground and allow the article to be drawn along the surface. The ground surface is represented at 28 in FIG. 1.

In addition, the wheel housings 17 and 18 can have rollers 29 and 30 which, when the rear wall is tilted to allow the wheels 26 and 27 to ride along the ground, first engage obstructions such as steps to facilitate passage of the assembly 16 over the step and to fend off impact with such obstructions.

Figure 3:
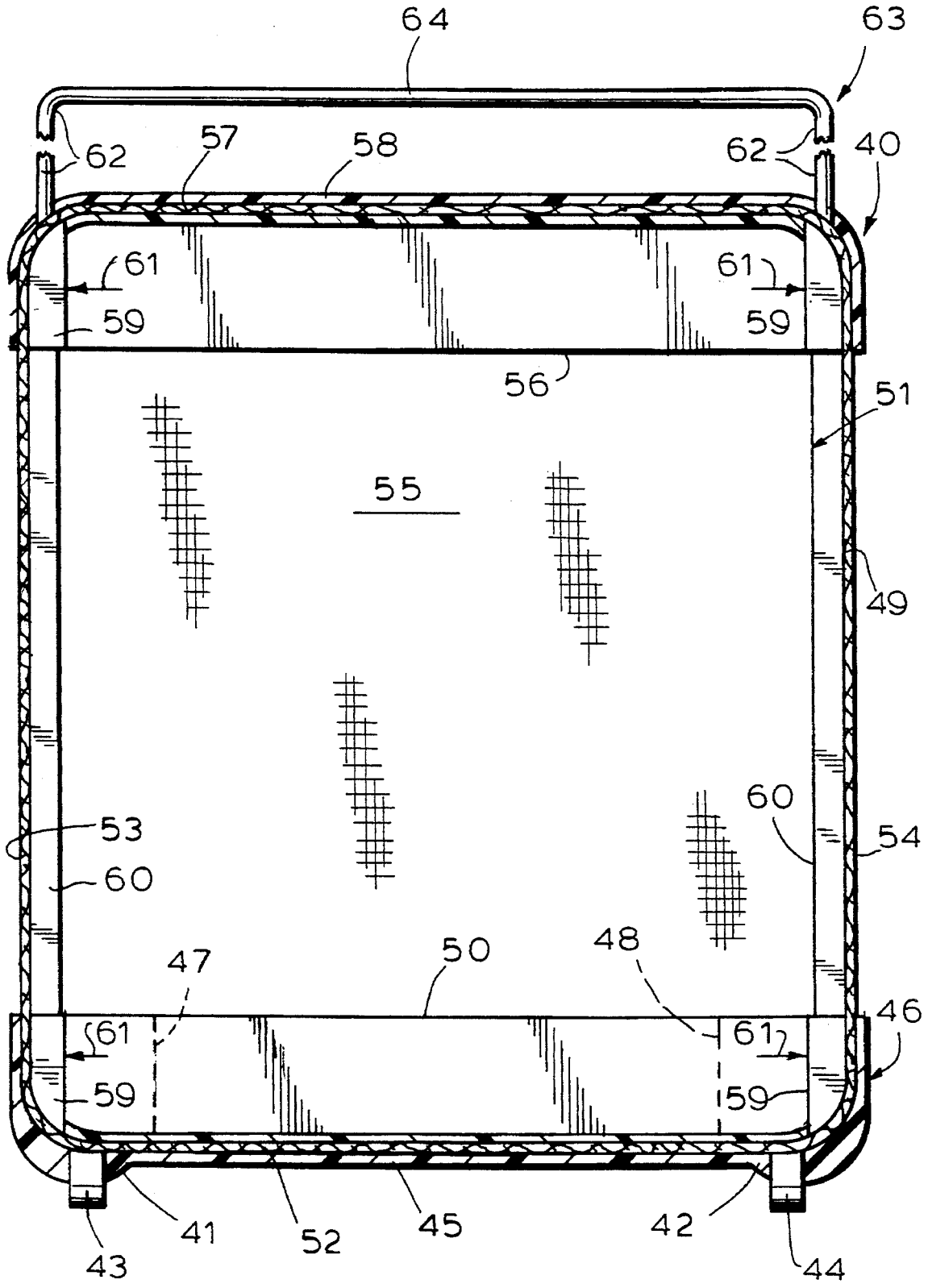
FIG. 3 is a vertical section through an article taken in a plane parallel to the rear wall thereof.

In the embodiment of FIGS. 2 and 3, the article of luggage 40 can be seen to have wheel housings 41 and 42 which may be provided with wheels 43 and 44 as described in connection with FIG. 1 and which are separated by the shield member 45 which contiguously adjoins the wheel housing members 41 and 42 of the wheel assembly 46 at the planes represented by the broken lines 47 and 48 in FIG. 3.

In this embodiment as well, the interior of the fabric container 49 is seen to receive a lower rigid member 50 forming the lower limb of a structuring frame 51. Member 50 is connected to the wheel assembly by screws or rivets in the manner described passing through the bottom wall 52 of the container 49, the wide wall 53 and 54 thereof and the rear wall 55, all composed of a fabric such as rip-stop nylon.

The frame 51 also comprises an upper limb 56 constituted by another molded plastic rigid element which can line the interior of the upper wall 57 of the container body 49 and can be attached to an outer rigid member 58 which can provide a support for a lifting handle (not shown) as is conventional on such articles of luggage.

The front panel or wall of the article is not visible in FIGS. 2 and 3 and may be provided with a zipper or other access to the interior. The frame may also be covered by a fabric web if desired.

The upper and lower limbs 50 and 56 are formed with sockets 59 in which the ends of aluminum tubular extrusions 60 are anchored. The tubular extrusions and/or the sockets 59 can be provided with detent elements such as fingers or the like represented by the arrows 61 to engage the shanks 62 of a handle 63 whose bail 64 is represented as a single bar in FIG. 3.

Thus when the handle 64 is fully inserted, the detents 61 engage the shanks and prevent undesired mobility of the handle. However, when the handle 63 is pulled upwardly and released from the lower detent 61, the shanks 62 can move freely without frictional retardation until the upper detents 61 are engaged, thereby locking the handle in its extended position. The detents can be of the type disclosed in our commonly assigned copending application Ser. No. 08/133,976 filed Oct. 8, 1993; and entitled ROLLING CATALOG CASE WITH PULL-OUT HANDLE).

The extrusions 60 and the sockets 59 can be of rectangular cross section and can have formations which interlock with one another so that once the extrusions are force-fitted into the sockets, they cannot be pulled apart.

It will be apparent that the extrusions 60 lie along the edges joining the side walls 53 and 54 with the rear wall 55.

In FIGS. 4–6, we have shown another interconnnection between a wheel housing 70 forming one member of a wheel assembly 71 for use in an article of luggage as described in FIGS. 1–3, and a shield member 72. In this case, both the wheel assembly 70 and the shield 72 are provided with overlapping flanges 73 and 74 connected by rivets 75 passing through slots in one of the two members, e.g. the shield member 72. The slots are shown at 76 in FIG. 4. The rivets 75 can be anchored in the interior frame member 77.

A comparison of FIGS. 5 and 6 shows that the wheel assembly 71 can be extended or contracted as represented by the arrow 78 upon assembly of the article to accommodate different widths. As a result, only a limited number of wheel assembly parts are required for a full range of luggage widths.

Figure 7:
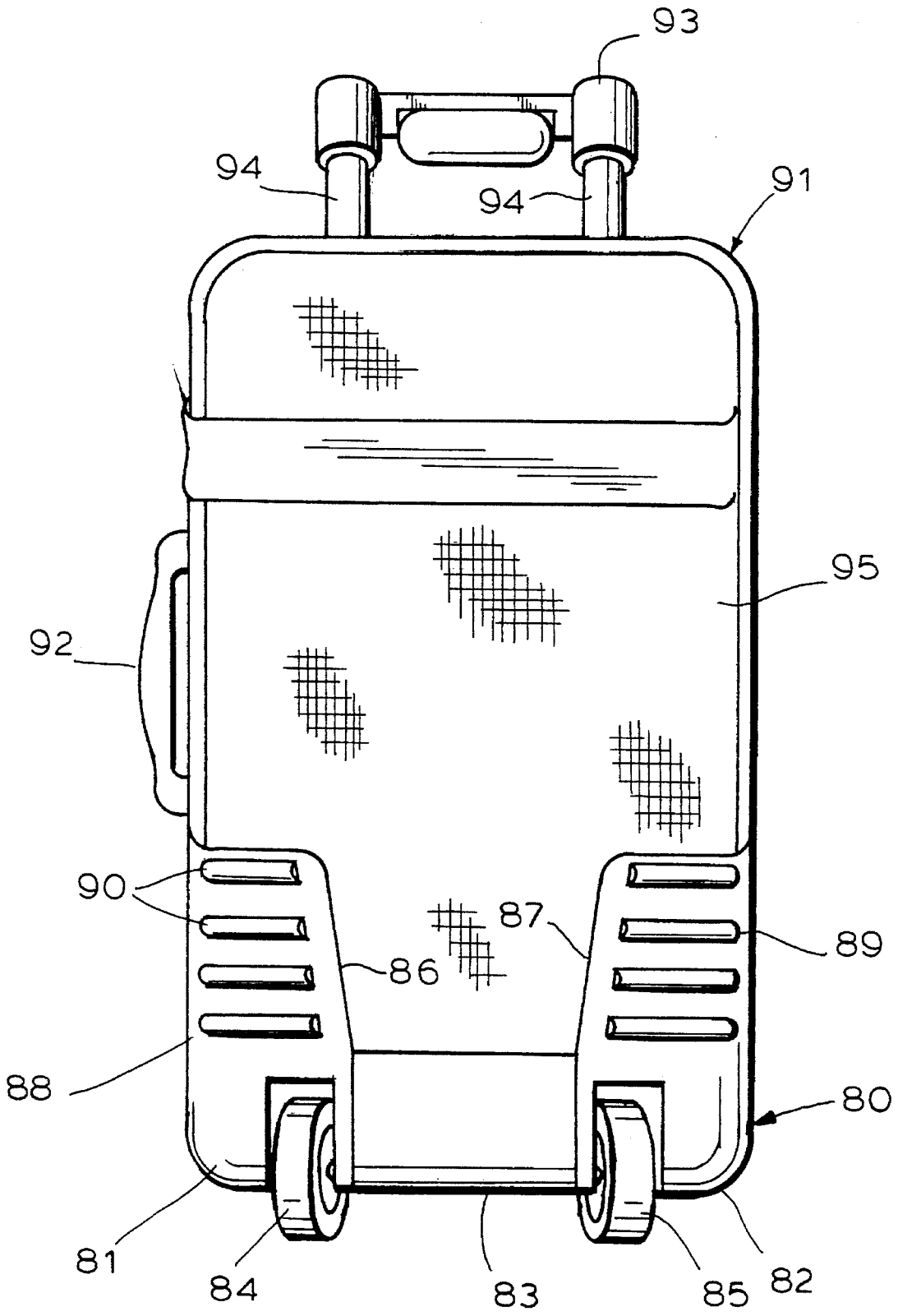
FIG. 7 is a rear view of another embodiment of the invention.
Figure 8:
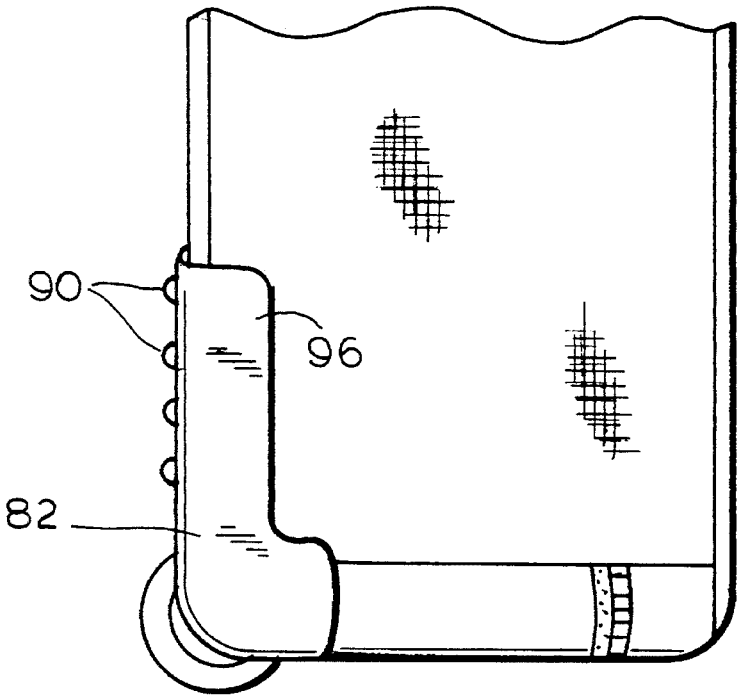
FIG. 8 is a side elevational view of this embodiment.

FIGS. 7 and 8 show that the wheel assembly 80, for example, formed by two wheel housings 81 and 82, interconnected by an impact shield 83 and formed with the wheels 84 and 85 can be extended upwardly at 86 and 87 to be provided with arrays of rollers 88 and 89 which are designed to encounter obstructions such as steps and to ease the article over them. The rollers 90 of the respective sets are here vertically spaced and have parallel axes, decreasing in length upwardly. The luggage article 91 can have a carrying handle 92 on a side wall thereof while a pull handle 93 can extend from the top. The shanks 94 can be guided in extrusions in the manner described although here the extrusions lie inwardly from the edges of the container 95. The wheel housings 81 and 82 have aprons 96 which extend over the side wall 97, for example, and thus also serve as edge protectors for the container 95.

Figure 9:
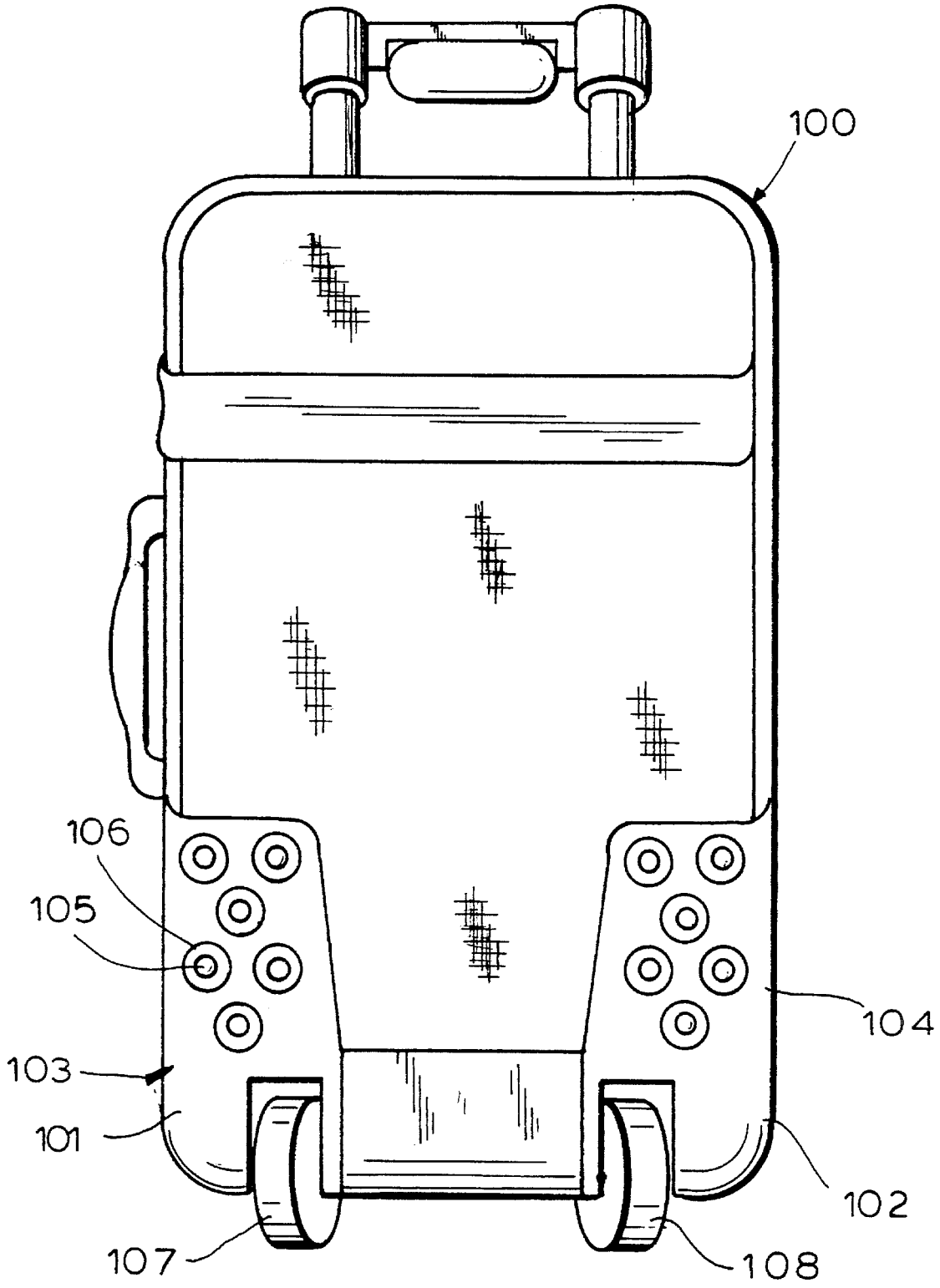
FIG. 9 is a view similar to FIG. 7 of an alternative construction.
Figure 10:
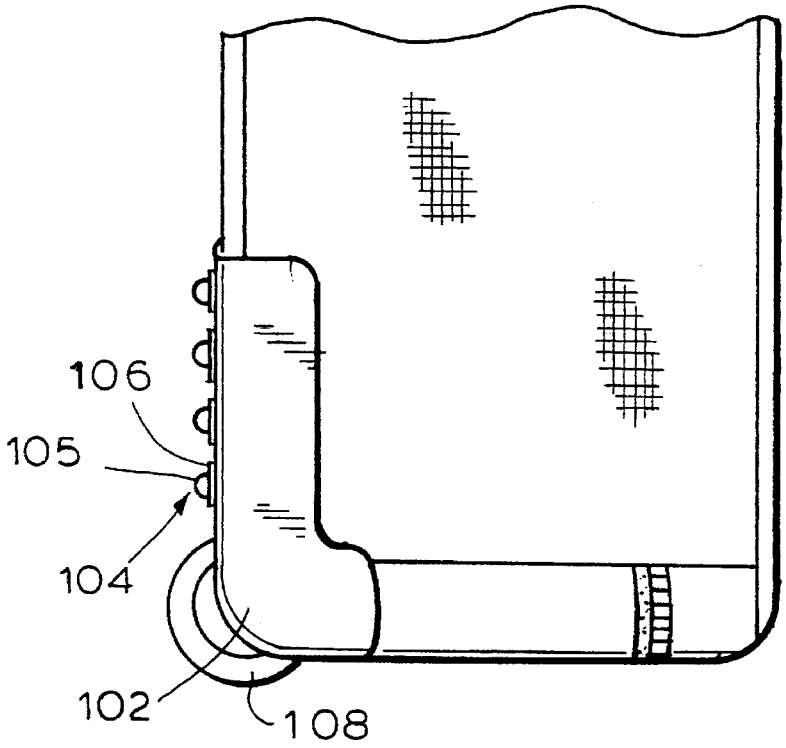
FIG. 10 is a side elevational view corresponding to FIG. 9.

A similar construction is provided for the article of luggage shown in FIGS. 9 and 10 and represented at 100. Here the wheel housings 101 and 102 are provided with arrays 103 and 104 of ball bearing rollers 105 in respective sockets 106 in a staggered arrangement above the wheels 107 and 108 upon which the article 100 can be drawn along the ground or floor surface.

Figure 11:
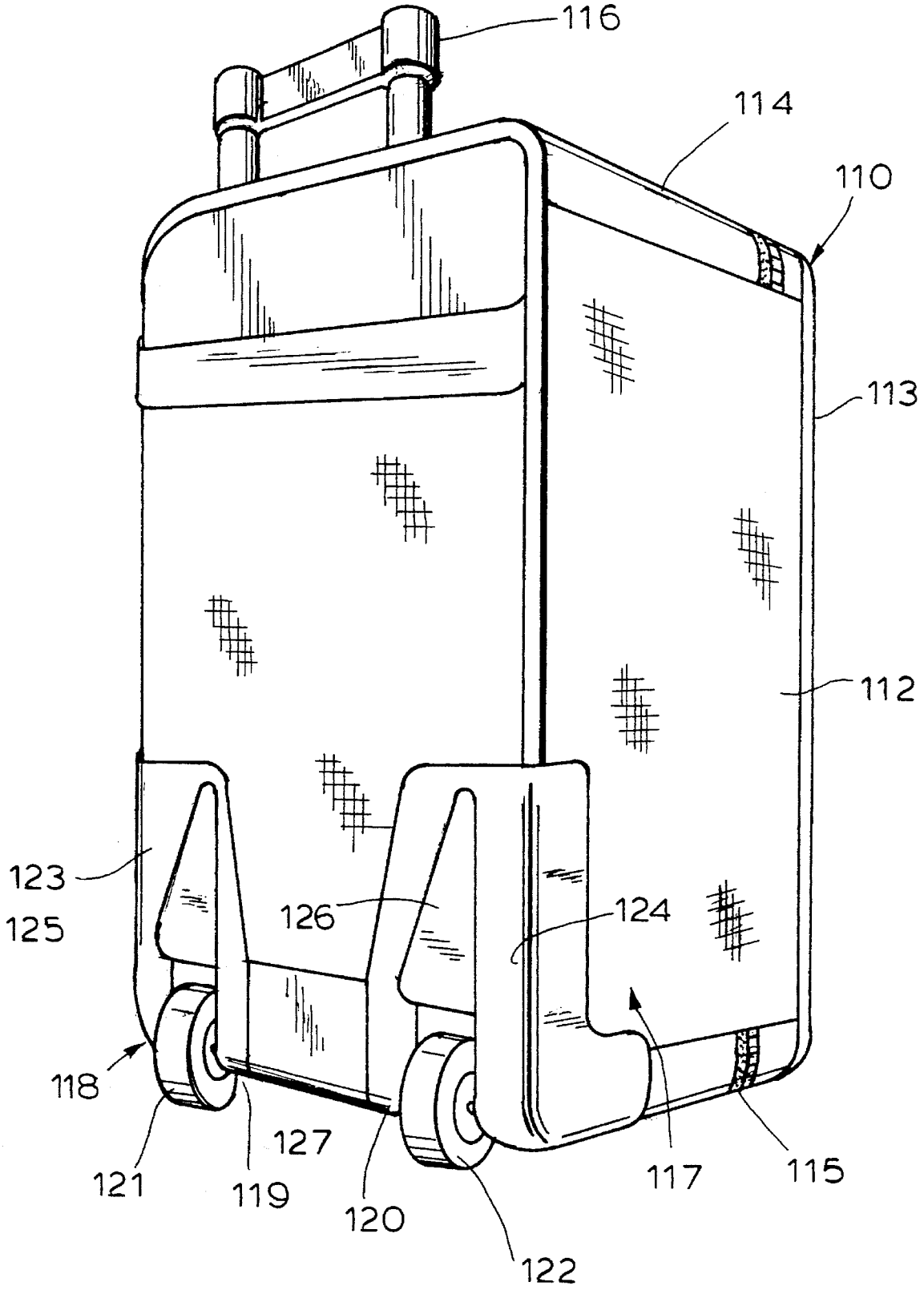
FIG. 11 is a perspective view diagrammatically showing another article of luggage embodying this invention.

The article 110 shown in FIG. 11 has a rear wall 111, side walls one of which have been shown at 112, a front wall 113 and top and bottom walls 114 and 115, respectively. That pull handle 116 can be extracted from a frame lying along the rear wall 111 and disposed internally of the body 117 of the article while a wheel assembly 118 is provided along the rear and bottom walls.

Here the wheel assembly comprises wheel housings 119 and 120 formed with wheels 121 and 122 with which the luggage can be rolled along the ground. On the upward extensions 123 and 124 of the wheel housings, tapered projections 125 and 126 are provided as fenders for guiding the article of luggage over any obstructions to minimize the impact upon the wheels 121 and 122. Here as well, the wheel housings 119 and 120 are separated by a rigid impact shield member 127.

We claim:

1. An article of luggage, comprising:

a generally rectangular parallelepipedal container having a top wall, a bottom wall, a front wall, a rear wall and two side walls;

a handle on said container enabling same to be drawn along a surface; and a wheel assembly spanning a full width of said container across said rear wall and adjacent said bottom wall and shielding said container against impact with obstructions encountered by said article as said article is drawn along said surface, said wheel assembly including at least two members adjustably interconnected along said width to enable adjustment of said assembly to containers of different width, said members carrying respective wheels on which the article is supported as it is drawn along said surface, at least one of said members being formed with roller means above said wheels for facilitating passage of said article over an obstruction encountered by said article, said roller means including at least one rolling body positioned above each of said wheels on a respective one of said members.

2. The article of luggage defined in claim 1 wherein said rolling bodies are each one of a respective plurality of mutually parallel rollers with axes parallel to an axis of the respective wheel and spaced apart above each wheel.

3. The article of luggage defined in claim 1 wherein each of said rolling bodies are each one of a respective multiplicity of spaced apart balls arrayed above each of said wheels.

* * * * *